United States Patent [19]

Fort et al.

[11] 4,008,751

[45] Feb. 22, 1977

[54] CASING FOR A MACHINE FOR CENTRIFUGALLY CASTING PIPES IN A ROTARY MOULD

[75] Inventors: Pierre Henri Marie Fort, Nancy; Michel Pierrel, Pont-a-Mousson, both of France

[73] Assignee: Pont-A-Mousson S.A., Nancy, France

[22] Filed: Feb. 24, 1975

[21] Appl. No.: 552,452

[30] Foreign Application Priority Data

Mar. 21, 1974 France ..... 74.09744

[52] U.S. Cl. ..... 164/153; 164/298; 425/435

[51] Int. Cl.[2] ..... B22D 13/10

[58] Field of Search ..... 164/153, 286, 300, 152, 164/272, 298, DIG. 3; 425/151, 435

[56] References Cited

UNITED STATES PATENTS

| | | | |
|---|---|---|---|
| 1,916,296 | 7/1933 | Barr et al. | 164/152 |
| 2,278,858 | 4/1942 | Fields | 164/298 X |
| 3,397,735 | 8/1968 | Taccone | 425/435 X |
| 3,412,785 | 11/1968 | Lorang | 164/298 X |
| 3,496,606 | 2/1970 | Rudge | 425/435 X |
| 3,555,615 | 1/1971 | Orme | 425/435 X |
| 3,773,447 | 11/1973 | Barratt | 425/435 X |

FOREIGN PATENTS OR APPLICATIONS

| | | | |
|---|---|---|---|
| 1,161,607 | 9/1958 | France | 425/435 |
| 144,972 | 3/1962 | U.S.S.R. | 164/286 |

*Primary Examiner*—Ronald J. Shore
*Assistant Examiner*—Gus T. Hampilos
*Attorney, Agent, or Firm*—Sughrue, Rothwell, Mion, Zinn & Macpeak

[57] ABSTRACT

The casing is stationary and has at least one end a transverse end wall which defines an opening affording access to the end of the casting mould. A screen axially projects from the transverse end wall and extends at least partly around the opening for the purpose of screening the machine operators off from any splashes of molten metal which might be thrown out of the mould due to a faulty socket core.

9 Claims, 6 Drawing Figures

CASING FOR A MACHINE FOR CENTRIFUGALLY CASTING PIPES IN A ROTARY MOULD

The present invention relates to a casing for a machine for centrifugally casting pipes in a rotary mould of the type which is stationary with respect to this mould.

The length of a casing for such a machine normally exceeds that of the mould which is generally provided at one end with a breech carrying a sand socket core and at the other end with a metal iron cutting ring. However, this additional length is not enough to prevent splashing of iron in this region which sometimes occurs under the following conditions.

At the start of the casting when the iron is brought by a trough to the end of the mould adjacent the socket, it sometimes occurs that the rate of flow of the iron is excessive or that the socket core does not resist the mechanical shock of the iron subjected to centrifugal force. It could also occur that the socket core be slightly damaged or cracked during handling. Consequently the iron centrifugally cast in the socket overflows through the centre aperture of the core or travels through interstices due to localized flaws in the core. The iron is then thrown outwardly under the effect of centrifugal force.

At the end of the pouring of the iron when the trough is withdrawn from the other end of the mould while still containing flowing liquid iron, the latter is also thrown outside the mould by the centrifugal force.

Such splashing of iron constitutes a danger for the personnel in the vicinity of the machine and, in any case, even if the personnel stays at a distance, this splashing might adversely affect the neighbouring equipment.

An object of the present invention is to overcome these drawbacks by providing an improved casing affording an improved protection of the personnel and equipment in the vicinity of the openings of this casing without hindering access to the machine. This casing for a machine for centrifugally casing pipes in a rotary mould comprises at, at least one end, a screen which is disposed in axially projecting relation to the transverse end wall of the casing at least partly around an opening of said end wall which opening gives access to one end of the mould.

According to an advantageous embodiment of the invention, the screen is secured to the transverse end wall of the casing.

This is notably the case of machines for centrifugally casting pipes of small and medium diameter up to large diameters not exceeding, for example, a size of the order of 600 mm.

Indeed, machines for centrifugally casting pipes having diameters exceeding 600 mm are usually equipped with a withdrawable gangway which can be brought transversely of the machine against the opening of its casing to allow inspection. This operation is therefore incompatible with the presence of a screen which axially projects from the casing and which is all the more space consuming as the dimension of the machine is large.

This is why, in accordance with another embodiment of the invention, a screen is mounted to be telescopically slidable along the casing of the machine at at least one of its ends.

Thus the screen is capable of withdrawing to the position of rest to allow access to the inspection gangway and it is capable of being moved to a protective projecting position with respect to the machine when casting, the gangway being then withdrawn.

Further features and advantages of the invention and its operation will be described hereinafter with reference to the accompanying drawings given by way of example and in which.

Figure 3:
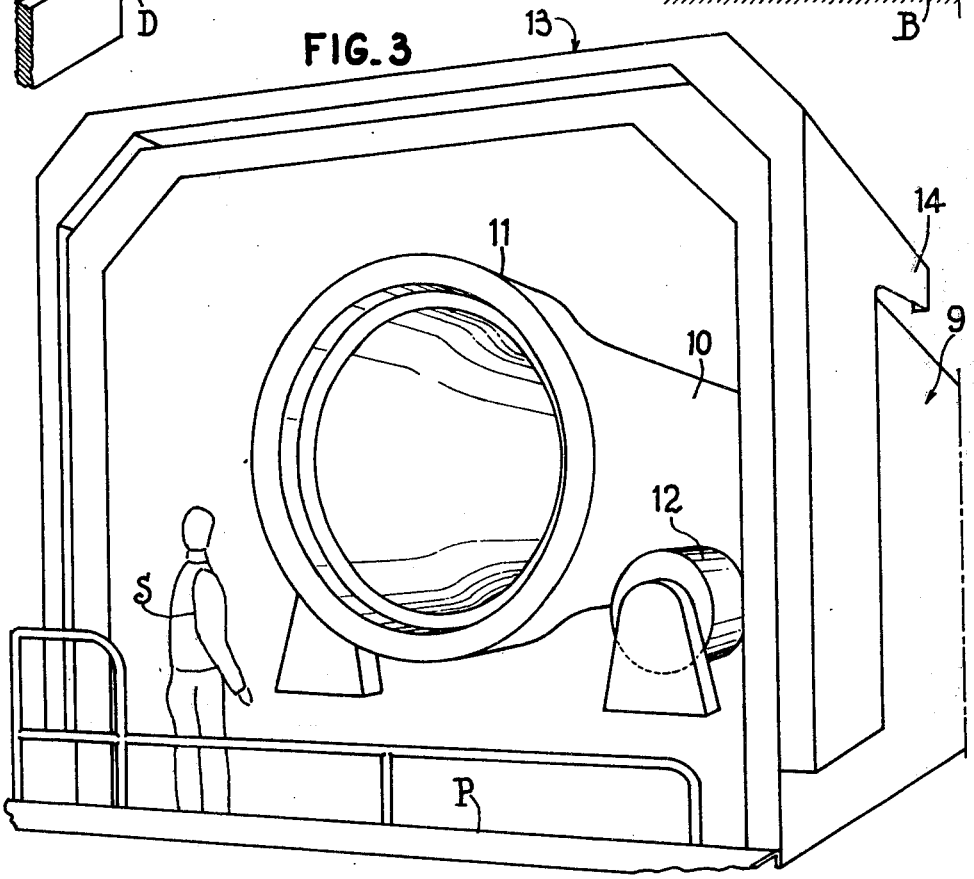
FIG. 3 is a diagrammatic perspective view of a machine according to the invention for large-diameter pipes, for example exceeding about 600 mm.
Figure 6:
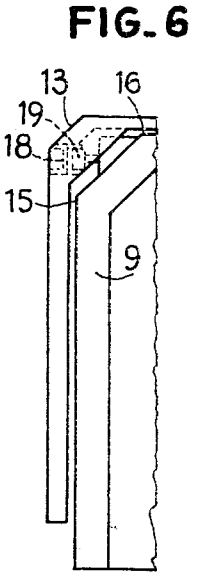
Figure 4:
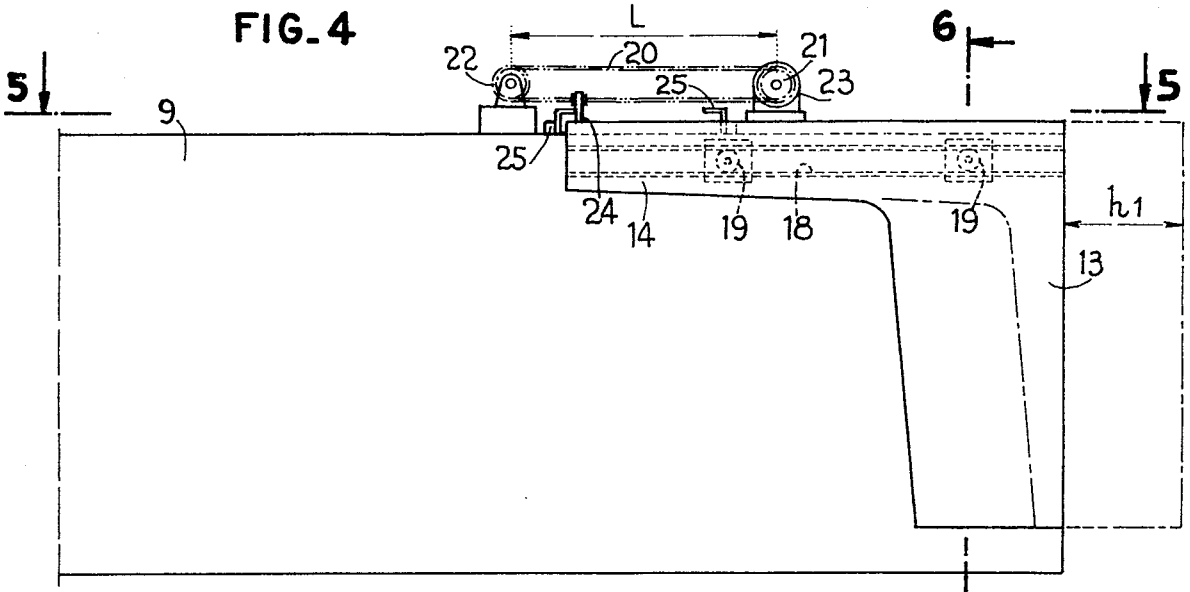
Figure 5:
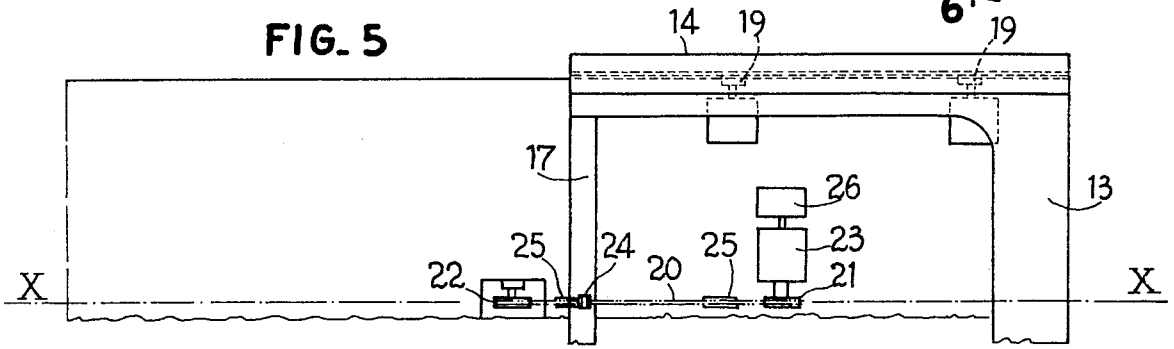

FIG. 4 is an elevational view to a reduced scale of the machine shown in FIG. 3, and FIGS. 5 and 6 are partial views, respectively in plan and in side elevation, taken along lines 5—5 and 6—6 of FIG. 4.

Figure 1:
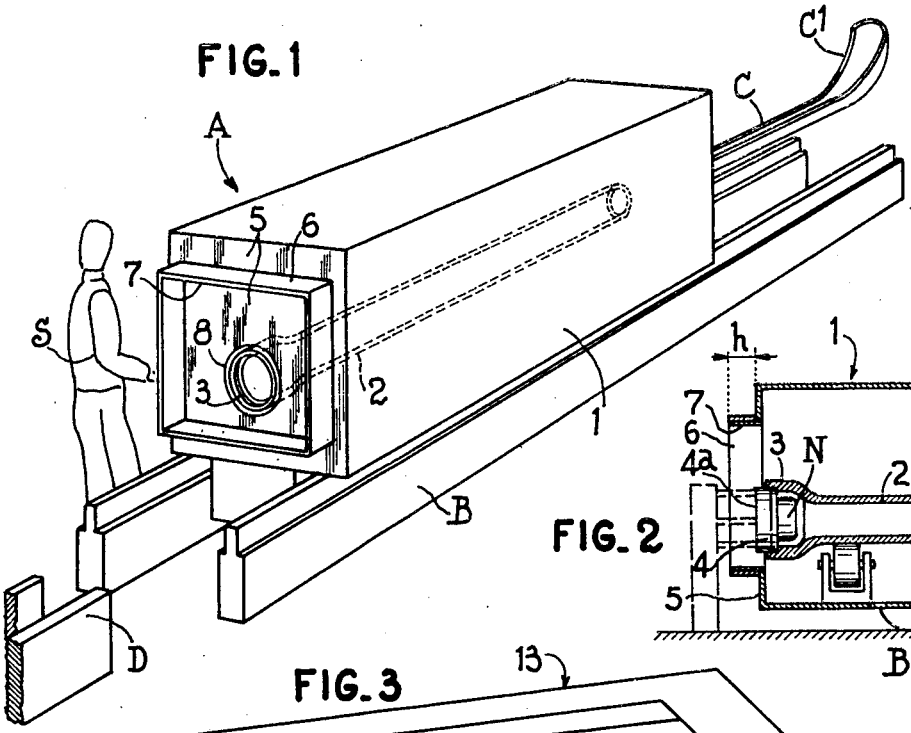
FIG. 1 is a diagrammatic perspective view of a machine according to the invention for pipes of small diameters and pipes up to diameters not exceeding, for example, about 600 mm.
Figure 2:
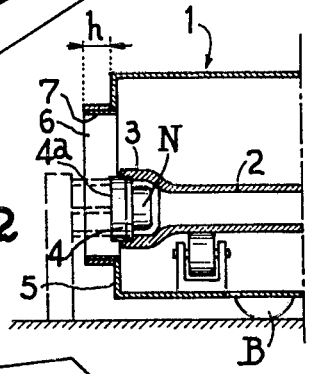
FIG. 2 is a partial diagrammatic detail view in elevation of the screen of the machine shown in FIG. 1.

In the embodiment shown in FIGS. 1 and 2, the invention is applied to a machine for centrifugally casting pipes of small and medium diameters and even large diameters, for example between 100 and 600 mm. In order to give an idea of the size of the machine, the silhouette of a person has been shown at S next to the machine.

This machine comprises in the known manner a carriage A having a casing 1 which is movable in translation along a runway B, an iron trough C having a pouring spout C1 and a runway D for a moulded pipe-extracting carriage (not shown). Inside the casing 1 a centrifugal casting mould 2 having a socket 3 is driven in rotation. The socket core N is maintained in the socket 3 with a support and locking ring 4 by a breech shown diagrammatically in dot-dash line in FIG. 2.

In accordance with the invention, there is fixed to the end wall 5 of the casing 1 adjacent the socket 3 of the mould 2 a screen 6 of enveloping shape, for example having a rectangular-sided surface which considerably projects to the extent *h* from the end wall 5 of the casing 1 and from the edge of the ring 4 secured to the breech. In FIG. 2 this edge of the ring 4 has the reference numeral **4*a* and is slightly offset with respect to the end wall 5 of the casing 1. This projection may be, for example, 0.2 to 0.4 m for a machine on this size. The screen 6 has a refractory lining 7 of the inside. The screen 6 defines about the opening 8 of the wall 5, which has a dimension at least equal to the section of the socket 3 of the mould 2, a large access area. In other words, the area defined by the screen 6 on the wall 5 is substantially greater than the section of the end socket 3 of the mould 2**.

By way of a modification, instead of being rectangular-sided, the screen 6 could have a tubular shape or a horseshoe shape the opening of which faces downwardly (inverted U).

In operation, a socket core N is placed in position in the socket 3 of the mould 2 which is rotated at a speed of the order of 100 rpm. When the iron poured into the upstream end of the trough C (spout C1) reaches the socket, if the socket core N has defects so that it cannot withstand the mechanical shocks due to the centrifugally cast iron, the latter, as it is thrown outwardly on all sides by the centrifugal force, is stopped by the screen 6 where it solidifies in the form of droplets or pools. The inner refractory lining 7 protects the sheet metal of the screen from direct contact with the iron and precludes heat distortion of the screen 6. When the machine stops, these droplets or pools of iron are easily withdrawn from the screen 6. The large area of the wall 5 formed by the screen 6 around the opening 8 for the passage of the socket 3 of the mould 2 allows an easy access to said socket and in particular the mounting and locking of the socket core N.

In the modification shown in FIGS. 3 to 6, the invention is applied to a machine for centrifugally casting pipes of very large diameters, for example from 600 to 2,000 mm. An idea can be had of the size of the machine from the silhouette of a person S shown on a withdrawable gangway P alongside the machine.

The machine is fixed in position. The long pouring trough (not shown) is movable in translation. Thus FIG. 3 shows the casing 9 of rectangular-sided shape of the machine, which casing is fixed in position. Mounted inside the casing 9 is a rotary centrifugal casting mould 10 having a socket 11 supported by rollers 12.

In accordance with the invention, there is slidably mounted at the end of the casing 9 adjacent the socket 11 a screen 13 whose shape differs from the screen 6 of the previous embodiment owing to a slidable mounting and different dimensions.

This screen 13 has the shape of an inverted U which conforms internally to the transverse shape of the outer wall of the casing 9. The lateral walls of the screen 13 have in their upper part extensions constituted by a pair of symmetrical longitudinal guide members 14 of appropriate length. The guide members 14 extend round the upper corners 15 and 16 connecting the upper wall of the lateral planar walls of the casing 9 and are interconnected at their ends to ensure stiffness by a strut 17 which extends transversely over the screen 13. When viewed in plan, the screen 13 forms with the members 14 and the strut 17 a stirrup-like structure.

For the purpose of sliding the screen 13, the members 14 carry internally guide runways 18, for example constituted by metal H-section members (FIGS. 4 and 6) and the casing 9 carries in its upper part, between the corners 15 and 16, support rollers 19 which roll along the runways 18. For the purpose of moving the screen 13 with respect to the casing 9 between an inoperative withdrawn position (in full line in FIG. 4) and a protecting position in which it projects to the extent $h1$ from the transverse face of the socket of the casing 9 (in dot-dash line in FIG. 4), the following system is employed which is particularly simple to construct.

Mounted on the upper planar wall of the casing 9 is an endless drive means, for example an endless chain 20 disposed between two sprocket wheels 21 and 22 whose centre distance L exceeds the travel or the projection $h1$ of the screen 13. The sprocket wheels 21 and 22 are mounted on each side of the strut 17, for example along the axis X—X of the casing 9 (FIG. 5), so that the endless chain 20 can travel in a vertical plane containing the axis X—X or in any case in the vicinity of the latter for reasons of balance. The front driving sprocket wheel 21 is rotated by a motor 23 also secured to the top of the casing 9. The lower reach of the chain 20 carries a pin 24 for shifting the screen 13 in translation. The pin 24 is secured to both the chain 20 and strut 17. The endless chain 20, and consequently the pin 24 and the screen 13, are capable of undergoing a rectilinear to-and-fro movement by reversing the direction of rotation of the motor 23. Two end-of-travel stops 25 are actuated, for example by the driving pin 24, to actuate a switch and stop the motor 23 in the known manner.

The detail of the electric control of the motor 23 of known type has not been shown in detail. This control comprises, for example, a timing device 26 for automatically starting up the motor at the start and at the end of the pouring of the iron into the mould.

This slidable screen operates in the following manner:

Upon pouring the iron when the end of the pouring trough (not shown) approaches the socket 11 of the mould 10 provided with a core (not shown), the motor 23 is simultaneously and automatically started up by the timing device 26 so as to cause the screen 13 to project from the transverse planar surface of the casing 9. The motor 23 is stopped when the pin 24 encounters the stop 25, the screen 13 then being in the position shown in dot-dash line. If there are any splashes of iron, they are stopped by the screen 13 whose inner surface is advantageously covered with a refractory material in the same way as the screen of the previously-described embodiment.

When the socket of the pipe has sufficiently solidified, the motor 23 is automatically started up in the opposite direction and causes the screen 13 to withdraw to its initial withdrawn position shown in full line.

The longitudinal members 14 carrying the runways 18 cooperating with the rollers 19 serve not only to guide but also to maintain the screen 13 in position and prevent its tilting when it is completely in overhanging position shown in dot-dash line.

As shown in FIG. 3, when the screen is withdrawn, a moving gangway P can be brought into position transversely of the axis of the mould 10 to facilitate access to the interior of the machine and facilitate the moving of the personnel around the machine.

By way of a modification, the rollers 19 may be carried by the longitudinal members 14 and the runways 18 by the casing 9. Moreover, the endless chain 20 may be replaced by a cable or belt.

The device for driving the telescopic screen 13 may also be a jack or a rack and pinion device or constituted by any like mechanical device.

The screen previously described as being located at the end of the mould pertaining to the socket may also be located and mounted at the other end of the mould adjacent the cylindrical male end.

We claim:

1. The combination of a machine for centrifugally casting a pipe in a rotary mould which is rotatable about an axis and has a socket-forming end portion, and a structure for shielding the mould and protecting against projections of molten metal from the socket-forming end portion of the mould, said structure consisting of a combination of a casing axially fixed with respect to the mould and having a transverse end portion adjacent the socket-forming end portion and defining a permanently open opening which is larger than the socket forming end portion and affords direct access to the socket-forming end portion of the mould, and a screen which is fixed against rotation about said axis and is separate from the rotary mould and axially projects outwardly from the transverse end portion of the casing and extends at least partly around said opening and allows unhindered access to said opening axially of the casing and is capable of receiving at least tangential projections of molten metal from the socket-forming end portion of the mould.

2. A structure for a machine for centrifugally casting pipes in a rotary mould rotatable about an axis, comprising in combination a fixed casing having a longitudinal axis parallel to said axis and surrounding the mould and axially fixed with respect to the mould and having a transverse end portion defining a permanently open opening which is located axially in the vicinity of an end of the mould and has a larger size than said end of the mould and affords direct access to said end of the mould, and means for protecting the surroundings of said end portion of the casing from projections of said product through said opening, said protecting means consisting of a screen which is separate from the rotary mould and mounted to be axially telescopically movable with respect to the casing between an operative position in which the screen axially projects from the transverse end portion of the casing and extends in the manner of a hood at least partly around said opening and allows unhindered access to said opening axially of the casing and an inoperative position in which the screen is withdrawn from said operative position and is substantially wholly coextensive with the casing, the screen being fixed against rotation about the longitudinal axis of the casing.

3. A structure for a machine for centrifugally casting pipes in a rotary mould rotatable about an axis, comprising in combination a fixed casing having a longitudinal axis parallel to said axis and surrounding the mould and axially fixed with respect to the mould and having a transverse end portion defining a permanently open opening which is located axially in the vicinity of an end of the mould and has a larger size than said end of the mould and affords direct access to said end of the mould and means for protecting the surroundings of said end portion of the casing from projections of said product through said opening, said protecting means consisting of a screen which is separate from the rotary mould and mounted outside the casing to be axially telescopically movable with respect to the casing between an operative position in which the screen axially projects from the transverse end portion of the casing and extends in the manner of a hood at least partly around said opening and allows unhindered access to said opening axially of the casing and an inoperative position in which the screen is withdrawn from said operative position and is substantially wholly coextensive with the casing, the screen being fixed against rotation about the longitudinal axis of the casing, drive means connected to the screen for selectively driving the screen toward said inoperative position and driving the screen toward said operative position, and stop means cooperative with means associated with the screen and operative to stop operation of the drive means automatically when the sleeve reaches said inoperative position and operative position.

4. A structure as claimed in claim 2, comprising control means extending axially of the casing and combined with the screen for shifting the screen axially of the casing between the operative position and the withdrawn inoperative position, and a drive means for driving the control means.

5. A structure as claimed in claim 4, further comprising means including a timing device for starting up the drive motor at the start of and at the end of the pouring of the metal into the mould.

6. A structure for a machine for centrifugally casting pipes in a rotary mould, comprising in combination a casing stationary in translation with respect to the mould and having a transverse end wall defining an opening affording access to an end of the mould, and a screen which axially projects from the transverse end wall of the casing and extends at least partly around said opening, the screen being mounted to be telescopically slidable relative to the casing, comprising control means extending axially of the casing and combined with the screen for shifting the screen axially of the casing between an operative position in which the screen axially projects from the transverse wall and a withdrawn inoperative position, and a drive motor for driving the control means, the control means comprising two wheels in spaced relation axially of the casing, supports fixed relative to the casing and carrying the wheels, an endless element extending round the two wheels, a pin secured to the screen and connected to the endless element, the drive motor being drivingly connected to one of the wheels, two fixed stops being disposed between the wheels for engagement by the pin and combined with switch means for stopping the electric motor in said operative and inoperative positions of the screen.

7. A structure as claimed in claim 2, wherein one of two elements consisting of the casing and the screen carries runways and the other of said two elements carries rollers which cooperate with the runways for facilitating the shifting of the screen relative to the casing.

8. A structure for a machine for centrifugally casting pipes in a rotary mould, comprising in combination a casing stationary in translation with respect to the mould and having a transverse end wall defining an opening affording access to an end of the mould, and a screen which axially projects from the transverse end wall of the casing and extends at least partly around said opening, the screen being mounted to be telescopically slidable relative to the casing, one of two elements consisting of the casing and the screen carrying runways and the other of said two elements carrying rollers which cooperate with the runways for facilitating the shifting of the screen relative to the casing, and control means comprising two wheels in spaced relation axially of the casing, supports fixed relative to the casing and carrying the wheels, an endless element extending round the two wheels, a pin secured to the screen and connected to the endless element, the screen comprising for its axial movement two extensions which extend axially of the casing, and a strut which carries the driving pin and extends transversely of the casing between the wheels and interconnects ends of the two extensions.

9. A structure as claimed in claim 2, comprising a refractory material covering an inner surface of the screen.

* * * * *